United States Patent [19]

Kydd et al.

[11] 4,400,263

[45] Aug. 23, 1983

[54] H-COAL PROCESS AND PLANT DESIGN

[75] Inventors: Paul H. Kydd, Lawrenceville; Michael C. Chervenak, Pennington; George R. DeVaux, Princeton, all of N.J.

[73] Assignee: HRI, Inc., Lawrenceville, N.J.

[21] Appl. No.: 232,789

[22] Filed: Feb. 9, 1981

[51] Int. Cl.[3] ..... C10G 1/06

[52] U.S. Cl. ..... 208/10

[58] Field of Search ..... 208/10

[56] References Cited

U.S. PATENT DOCUMENTS

| | | | |
|---|---|---|---|
| 3,769,198 | 10/1973 | Johanson et al. | 48/197 R X |
| 3,519,555 | 7/1970 | Keith et al. | 208/108 X R |
| 3,540,995 | 11/1970 | Wolk et al. | 208/10 |
| 3,640,816 | 2/1972 | Bull et al. | 208/10 |
| 3,769,198 | 10/1973 | Johanson et al. | 48/197 R X |
| 4,054,504 | 10/1977 | Chervenak et al. | 208/10 |
| 4,113,602 | 9/1978 | Gorboty et al. | 208/10 X R |
| 4,189,372 | 2/1980 | Baldwin et al. | 208/10 X R |
| 4,264,429 | 4/1981 | Rosenthal et al. | 208/10 |
| 4,264,430 | 4/1981 | Kuebler | 208/10 |
| 4,298,451 | 11/1981 | Neworth | 208/10 X R |

FOREIGN PATENT DOCUMENTS

| | | | |
|---|---|---|---|
| 902529 | 6/1972 | Canada | 208/10 |
| 2,737,192 | 5/1978 | Fed. Rep. of Germany | 208/10 |

*Primary Examiner*—Delbert E. Gantz
*Assistant Examiner*—William G. Wright
*Attorney, Agent, or Firm*—V. A. Mallare; F. A. Wilson

[57] ABSTRACT

A process for converting coal and other hydrocarbonaceous materials into useful and more valuable liquid products. The process comprises: feeding coal and/or other hydrocarbonaceous materials with a hydrogen-containing gas into an ebullated catalyst bed reactor; passing the reaction products from the reactor to a hot separator where the vaporous and distillate products are separated from the residuals; introducing the vaporous and distillate products from the separator directly into a hydrotreater where they are further hydrogenated; passing the residuals from the separator successively through flash vessels at reduced pressures where distillates are flashed off and combined with the vaporous and distillate products to be hydrogenated; transferring the unseparated residuals to a solids concentrating and removal means to remove a substantial portion of solids therefrom and recycling the remaining residual oil to the reactor; and passing the hydrogenated vaporous and distillate products to an atmospheric fractionator where the combined products are fractionated into separate valuable liquid products. The hydrogen-containing gas is generated from sources within the process.

20 Claims, 1 Drawing Figure

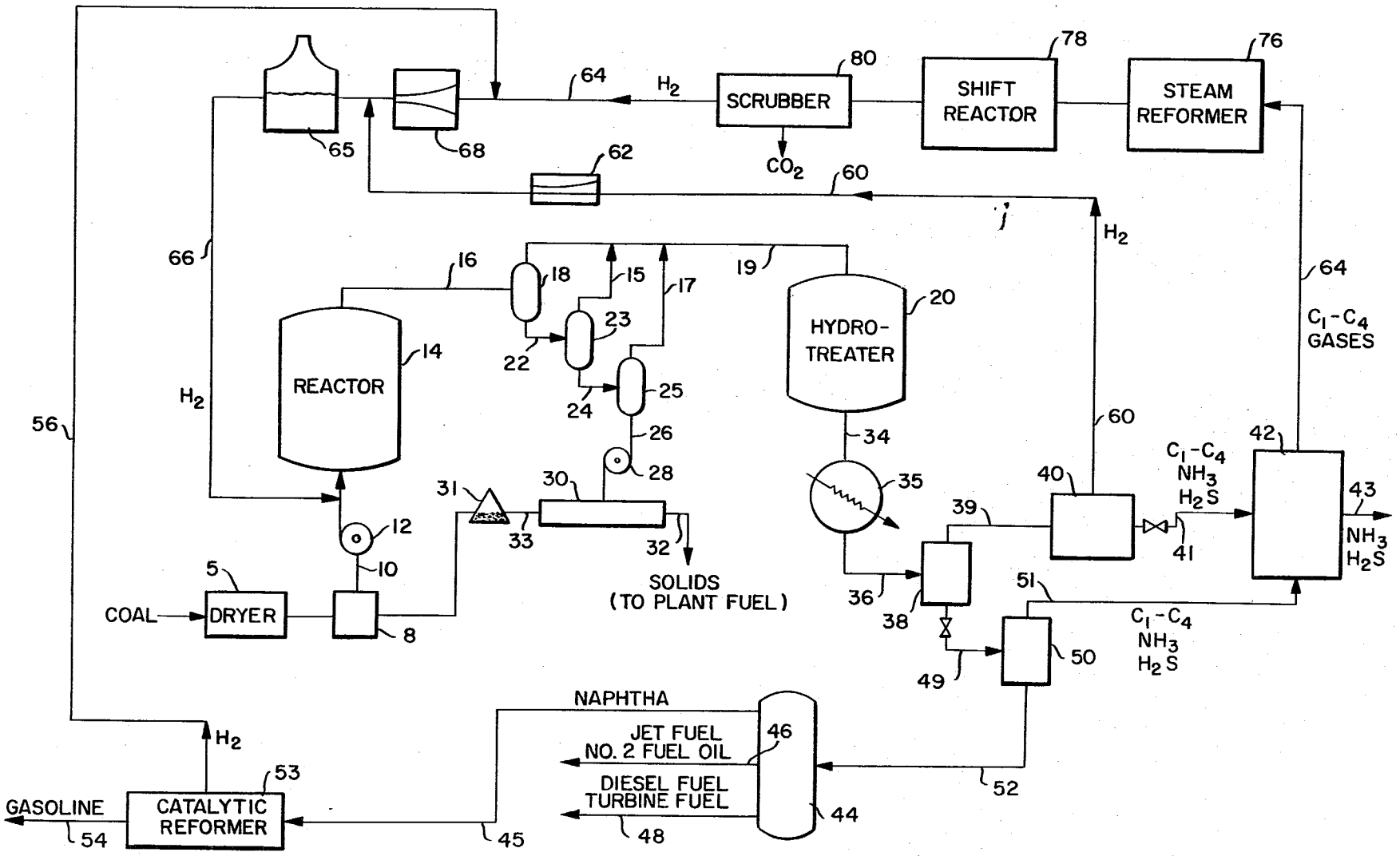
STEAM REFORMER
SHIFT REACTOR
SCRUBBER
$CO_2$
$H_2$
$C_1-C_4$ GASES
$NH_3$
$H_2S$
$C_1-C_4$
HYDRO-TREATER
REACTOR
DRYER
COAL
SOLIDS (TO PLANT FUEL)
NAPHTHA
JET FUEL NO. 2 FUEL OIL
DIESEL FUEL TURBINE FUEL
CATALYTIC REFORMER
GASOLINE

H-COAL PROCESS AND PLANT DESIGN

This invention was made in the course of or under Contract No. EF-77-6-07-2547 with the U.S. Department of Energy.

BACKGROUND OF THE INVENTION

This invention is related to the hydrogenation of coal and other hydrocarbonaceous materials for the production of liquid fuels, such as gasoline and jet, turbine and diesel fuels.

A process that has been used for the conversion of coal to liquid products is the H-Coal Process disclosed in U.S. Pat. Nos. 3,519,555 and 3,540,995 which converts coal to gaseous and liquid products by hydrogenation in an ebullated catalyst bed reactor. The present invention is related to improvements in the H-Coal Process and the plant process design and equipment used therein. The present invention is directed to increasing the conversion of coal into valuable hydrocarbon liquid products, such as jet fuels and diesel fuels, by utilizing an on-line hydrotreater, atmospheric and vacuum flash vessels and a solids concentrating and removal means such as a centrifuge for removing solids from the residual oil which is recycled into the reactor, as well as converting gases within the process to provide the hydrogen needed.

The conversion and utilization of coal to produce other more valuable fuel products has been actively carried out for more than half a century. With the advent of the internal combustion engine, and with relatively limited petroleum supplies in some countries of the world, technical efforts were accelerated to convert coal to liquid fuels. In many cases, this work was supported by the military, who realized the need for a dependable supply of liquid fuels in case of war, utilizing available coal deposits.

There are, of course, in the conversion of coal, many mechanical problems in handling coal, as well as the problems of high pressure hydrogenation. It is recognized that coal, as a solid, flows with difficulty. Also, it has a low hydrogen content, and it contains ash. While these obstacles can be overcome technically, the development of a practical economic process for the conversion of coal to more desirable solids-free forms has had many problems involved.

The present invention utilizes a combination of features which make the process for conversion of coal to liquids more efficient, and produes more of the valuable liquid products, such as jet and diesel fuels, and uses the light hydrocarbon gases to generate the hydrogen needed in the process.

SUMMARY OF THE INVENTION

The present invention provides a more efficient process for the conversion of coal and other hydrocarbonaceous materials by the H-Coal Process to produce valuable liquid fuels. The process comprises: (a) feeding coal and/or other hydrocarbonaceous materials with a hydrogen-containing gas into an ebullated catalyst bed reactor; (b) passing the reaction products into a separator where the vaporous and distillate products are separated from the residuals; (c) introducing the vaporous and distillate products from the separator directly into a catalytic hydrotreater where the products are further hydrogenated; (d) passing the residuals from the separator successively through flash vessels at reduced pressures such as atmospheric and vacuum pressure where distillates are flashed off and combined with the vaporous and distillate products to be hydrogenated; (e) transferring the unseparated residuals to a solids concentrating and removal means to remove a substantial portion of solids therefrom and recycling residual oil to the reactor; and (f) passing the hydrogenated distillate products to a fractionator where the combined products are fractionated into separate valuable products. The hydrogen-containing gas is generated from sources within the process.

BRIEF DESCRIPTION OF THE DRAWING

The accompanying drawing is a flow diagram of the present plant process and illustration of the plant design, wherein coal and/or other hydrocarbonaceous materials are converted into useful and more valuable products.

DETAILED DESCRIPTION OF THE PREFERRED EMBODIMENT

In the conversion of coal to more valuable fuel products by the present H-Coal Process, a coal, such as bituminous or subbituminous coal or lignite, is fed with a mixture of recycle oil and hydrogen into an ebullated catalyst bed reactor under conditions sufficient to convert the coal and other materials to vaporous and distillate products, residuals, and other hydrocarbon materials. These materials are passed to a hot separator where a substantial portion of the vaporous and distillate products are separated from the residuals and then introduced into a fixed catalyst bed hydrotreater where the products are further hydrogenated. The resulting hydrogenated liquid portion is passed through a fractionator usually at atmospheric pressures where the combined products are fractionated into separate products; e.g., naphtha, jet fuel and diesel fuel. If desired, the naphtha can be catalytically reformed to produce gasoline.

The residuals from the hot separator are passed successively through flash vessels usually at atmospheric and vacuum pressures where distillates are flashed off and combined with the vaporous and distillate products from the separator, and are hydrotreated. The residuals are drawn off from the bottom of the flash vessels and passed through a solids concentrating and removal means where a substantial portion of the unconverted coal and ash solids are removed from the residuals, leaving residual oils. The residual oil overflow portion containing a reduced solids concentration is recycled and fed into the reactor with coal and/or other hydrocarbonaceous feed materials. The solids concentrating and removal means that may be used according to the present process include a centrifuge, a hydroclone or a solvent precipitator. The centrifuge has been found to perform most effectively and is preferred. The residual oil underflow portion containing at least about 50W % solids is used as plant fuel within the process.

The successive atmospheric and vacuum flash vessels are used in this process to strip the maximum distillable liquid product from the reactor slurry for further treatment in the hydrotreater. Control of the composition of the residual recycle oil returning to the reactor can be achieved by controlling the pressure in the vacuum flash vessel to leave more or less vacuum distillate in the recycle oil.

In the use of the hydrotreater, there is provided an on-line hydrotreatment of vaporous and distillate products to directly provide useful and valuable liquid products such as jet and diesel fuels. In the hydrotreater, the products as a gas/liquid mixture are treated to remove substantially all of the undesired sulfur and nitrogen and to saturate and olefins and aromatics present. Thus, a high-grade valuable product is produced directly in one continuous process, instead of requiring two separate processes; i.e., conversion and hydrotreating processes.

Referring now to the accompanying drawing, there is shown a simplified flow diagram of the present H-Coal Process. In that diagram, coal and/or other hydrocarbonaceous materials are mixed with recycled oil at 8 and fed as a coal-oil slurry into line 10 through pump 12 and with a hydrogen-containing gas into an ebullated catalyst bed reactor 14, wherein the coal and other materials are reacted and converted into a combination of hydrocarbon products; i.e., vaporous and distillate products, residuals, unconverted coal and other hydrocarbons (e.g., olefins and aromatics). Prior to being fed through line 10 into the reactor 14, the coal is preheated in a dryer 5 to a temperature of about 350° F. or below a temperature at which any devolatilization or coking occurs. Operation of the ebullated bed reactor 14 is generally disclosed in U.S. Pat. No. 3,769,198, which is incorporated herein by reference to the extent necessary.

The reaction products, including the vaporous and distillate products and the residuals, are passed from the reactor 14 through line 16 into a high temperatures separator 18, where the vaporous portion is evolved from the top of the separator 18 through line 19 directly into an on-line catalytic hydrotreater 20, where the products are further treated to remove undesired materials including sulfur and nitrogen. At the same time, the liquid portion is passed through line 22 to an atmospheric flash vessel 23 where distillates are flashed off through line 15 and combined with the vaporous stream from the separator 18 in line 19 to the hydrotreater 20. The remaining residuals are then passed through line 24 into a vacuum flash vessel 25, where more distillates are flashed off through line 17 and combined with those in line 15 from the atmospheric flash vessels 23 and the vaporous stream from the separator 18 in line 19 and the mixture passsed to the on-line hydrotreater 20.

The residuals are transferred from the vacuum flash vessel 25 through line 26 by pump 28 into a solids concentrating and removal means 30 (e.g., a centrifuge), where a substantial portion of the unconverted coal and ash, solids in the residuals; e.g., residual oil, preferably at least about 90W % of the contained solids, are separated therefrom. The solids removed by the centrifuge form a part of an underflow slurry which is passed through line 32 and used as plant fuel to heat up various materials and gases of the present process. The underflow slurry contains at least about 50W % and as much as 60W % solids.

The residual oil overflow portion removed or passed from the centrifuge 30 is substantially free of solids. Approximately 90% of the solids of the residual oil have been removed by passing through the centrifuge 30. The residual or recycle oil is passed from the centrifuge through a heater 31 in line 33 and mixed at 8 with the preheated coal. Then the coal-oil slurry is passed to line 10 and fed into the reactor 14 with the hydrogen at 66 produced from gases in the present system and as described below.

The vaporous and distillate products which have been passed through line 19 to the hydrotreater 20 are treated therein. In the hydrotreater, which is a fixed catalyst bed unit, the vaporous and distillate products are hydrogenated ro remove undesirable products such as sulfur and nitrogen. The hydrotreatment also serves to saturate the olefins and aromatics present in the products treated. According to the present invention, catalytic hydrotreatment of hydrocarbons containing nitrogen and sulfur under exceptionally severe conditions of temperature and pressure in a fixed bed yields products which are denitrogenated and desulfurized to remarkably low levels, even in the presence of $H_2S$ and $NH_3$.

After the products have been hydrotreated at 20, they are passed through line 34 to a cooler 35. From the cooler 35, liquid and gaseous materials including hydrogen, hydrocarbons, $H_2S$ and $NH_3$ are passed through line 36 into a phase separator 38 from which there is evolved gases, converted products and hydrogen. The gases are passed through line 39 to a hydrogen purification system 40 where a gas, consisting essentially of hydrogen, is recovered and passed through line 60 for recycle to the reactor 14. The hydrogen passes through a recycle compressor 62 into line 64 and through a heater 65 from which the hydrogen passes through line 66 into feed line 10 and to the reactor 14. The gases other than the hydrogen, including $NH_3$, $H_2S$, $C_1$–$C_4$ hydrocarbons, pass from the hydrogen purification system 40 through line 41 to a $C_1$–$C_4$ hydrocarbon purification system 42. In this system 42, the $C_1$–$C_4$ hydrocarbons are recovered and passed through line 64 to a stream reformer 76. The $C_1$–$C_4$ hydrocarbons are converted to hydrogen as described below, and the $H_2S$ and $NH_3$ are evolved through line 43 to separate recovery systems (not shown).

The liquids pass from the phase separator 38 through line 49 to a stabilizer 50 where the $C_1$–$C_4$ hydrocarbons and other materials are separated from the hydrogen products (i.e., $C_5$ and higher hydrocarbons). The $C_1$–$C_4$ hydrocarbons with $NH_3$, $H_2S$ and other materials are passed through line 51 to the $C_1$–$C_4$ hydrocarbon purification system 42. The $C_1$–$C_4$ hydrocarbons, with those from the hydrogen purification system 40, are recovered and pass through line 64 to steam reformer 76.

The $C_1$–$C_4$ hydrocarbons, as described below, are converted by steam reforming to hydrogen. The $NH_3$ and $H_2S$ are evolved through line 43 to separate recovery systems (not shown). The converted hydrocarbon (i.e., $C_5$, etc.) products passing through the stabilizer 50 are further passed through line 52 into a low pressure fractionator 44 where the combination of converted products are fractionated into separate useful and valuable liquid products. Specifically, these products are essentially (a) jet fuel or No. 2 fuel oil, (b) diesel or turbine fuel, and (c) naphtha. The jet fuel, or No. 2 fuel oil, is provided through line 46, and the diesel or turbine fuel is provided through line 48. The naphtha is provided through line 45 into a catalytic reformer 53 where it is reformed or converted into gasoline which is provided through line 54.

The hydrogen emitted from the hydrogen purification system 40 in line 60 is a hydrogen-containing gas which is recycled and used in the present process and plant. This gas contains from about 70% to about 80% hydrogen. As described above, the hydrogen-containing gas in line 60 passes through recycle compressor 62 into line 64 which leads into a slurry-fired heater 65. The hydrogen is heated to a sufficiently high temperature, and from the heater 65 is passed through line 66 into line 10 and fed with the preheated coal and residual oil into the reactor 14.

According to the present invention, additional hydrogen-containing gas is generated from two sources within the process. The first source is from the naphtha stream 45, which is reformed at 53. This hydrogen-containing gas at line 56 is passed to line 64 where it is pressurized by compressor 68 and passed through the heater 65 into line 66. Accordingly, the hydrogen-containing gas passes into line 10 and is fed into the reactor 14 with the coal and residual oil. The second and preferably the major source of a hydrogen-containing gas is generated from the combination of $C_1$–$C_4$ gases (e.g., methane, propane, etc.) from the $C_1$–$C_4$ hydrocarbon gas purification system 42. The $C_1$–$C_4$ hydrocarbon gases pass from the system 42 through a slurry-fired steam reformer 76 where the light gases are converted to hydrogen and carbon monoxide. For example, in the case of methane $$CH_4 + H_2O \rightarrow 3H_2 + CO$$

The gases exiting the steam reformer 76 consist essentially of hydrogen; i.e., approximately 95% to 99%. The gases are then passed through a shift reactor 78 where the carbon monoxide is reacted with $H_2O$ (steam) to form additional hydrogen and carbon dioxide:

$$CO + H_2O \rightarrow H_2 + CO_2$$

The resulting gases are then passed through a scrubber 80 where the carbon dioxide is scrubbed out and the hydrogen is combined with the hydrogen in line 56 from the catalytic reformer 53 and passed through the compressor 68 and through the slurry-fired heater 65 and into the feed line 10 by means of line 66 and fed into the reactor 14 with the preheated coal and residual oil.

It is an important feature of this invention that the underflow slurry oil at 32 from the solids concentrating and removal means 30 is used as plant fuel, preferably to fire and heat the catalytic reformer 53, stream reformer 76 and hydrogen heater 65.

In the present process and plant design, as described above, the reactor and hydrotreater operate under similar conditions of temperature and pressure. The reactor and hydrotreater operate under a temperature ranging from about 750° F. to about 850° F. and a hydrogen partial pressure of between about 2,000 and about 3,200 psi. The reactor generally operates under a temperature ranging from about 800° F. to about 850° F., whereas the hydrotreater operates at a temperature ranging from about 750° F. to about 825° F. The fractionator 44 operates at a pressure within the range of atmospheric to about 50 psi.

The catalyst used in both the reactor 14 and hydrotreater 20 may be any catalyst suitable for coal hydrogenation and which can remain stable under the operating conditions of the reactive units. Typical catalysts that could be used include cobalt-molybdenum or nickel-molybdenum on an alumina support.

What is claimed is:

1. A process for converting coal and/or other hydrocarbonaceous materials to more valuable liquid products, said process comprising:

(a) feeding coal and/or other hydrocarbonaceous materials with a hydrogen-containing gas into an ebullated catalyst bed reactor;

(b) passing the reaction products from the reactor to a separator where vaporous and distillate products are separated from the residuals of said reacted products;

(c) introducing the vaporous and distillate products directly from the separator to a fixed catalyst bed hydrotreater where said products are further hydrogenated;

(d) passing the residuals from said separator successively through flash vessels at reduced pressures where distillates are flashed off and combined with the vaporous and distillate products to be hydrogenated;

(e) transferring the unseparated residuals to a solids concentrating and removal means to remove a substantial portion of solids therefrom and recycling the residual oil to the reactor; and (f) passing the hydrogenated distillate products from said hydrotreater to a low pressure fractionator where the combined products are fractionated into separate liquid products.

2. The process of claim 1, wherein the reactor and hydrotreater operate under similar conditions of temperature and hydrogen partial pressure.

3. The process of claim 2, wherein the reactor and hydrotreater operate under a temperature ranging from about 750° F. to about 850° F. and a pressure of between 2,000 and 3,200 psi.

4. The process of claim 1, wherein the coal and/or other hydrocarbonaceous materials and the recycled residual oil are separately preheated.

5. The process of claim 4, wherein the coal is preheated to a temperature of about 350° F. before being mixed with the recycled residual oil and fed into said reactor.

6. The process of claim 1, wherein at least about 90% of the solids are removed from said residuals prior to said residual oil being recycled to said reactor.

7. The process of claim 1, wherein the solids concentrating and removal means is a centrifuge.

8. The process of claim 1, wherein said hydrogen-containing gas is generated from within the process.

9. The process of claim 8, wherein said hydrogen-containing gas is generated from naphtha in a catalytic reformer and from $C_1$–$C_4$ hydrocarbon gases in a steam reformer.

10. The process of claim 6, wherein the residual underflow portion containing at least about 50W % solids is used as fuel for said process.

11. The process of claim 1, wherein said flash vessels operate at atmospheric and vacuum pressures.

12. The process of claim 1, wherein said fractionator operates within pressure range of about atmospheric to 50 psi.

13. A process for converting coal and/or other hydrocarbonaceous materials to more valuable liquid products, said processing comprising:

(a) feeding coal and/or other hydrocarbonaceous materials with a residual oil and a hydrogen-containing gas generated from within the process into an ebullated catalyst bed reactor;

(b) passing the reaction products from the reactor to a separator where vaporous and distillate products are separated from the residuals of said reacted products;

(c) introducing the vaporous and distillate products directly from the separator to a fixed catalyst bed hydrotreater where said products are further hydrogenated;

(d) passing the residuals from said separator successively through atmospheric and vacuum flash vessels where distillates are flashed off and combined with the vaporous and distillate products to be hydrogenated;

(e) transferring the unseparated residuals to a solids concentrating and removal means to remove a substantial portion of solids therefrom and recycling the residual oil to the reactor; and (f) passing the hydrogenated vaporous and distillate products from said hydrotreater to an atmospheric fractionator where the combined products are fractionated into separate liquid products.

14. The process of claim 13, wherein the reactor and hydrotreater operate under similar conditions of temperature and hydrogen partial pressure.

15. The process of claim 14, wherein the reactor operates under a temperature ranging from about 800° F. to about 850° F. and the hydrotreater operate under a temperature ranging from about 750° F. to about 825° F. and both said reactor and hydrotreater operate under a pressure of between about 2,000 and about 3,200 psig.

16. The process of claim 13, wherein the coal and/or other hydrocarbonaceous materials and the recycled residual oil are separately preheated.

17. The process of claim 16, wherein the coal is preheated to a temperature of about 350° F. before being mixed with the recycled residual oil and fed into said reactor.

18. The process of claim 13, wherein at least about 90% of the solids are removed from said residuals prior to said residual oil being recycled to said reactor.

19. The process of claim 13, wherein the solids concentrating and removal means in a centrifuge.

20. The process of claim 13, wherein said hydrogen-containing gas is generated from naphtha by catalytic reforming and from $C_1$–$C_4$ hydrocarbon gases by steam reforming.

* * * * *